United States Patent [19]

Buckley

[11] 3,959,679

[45] May 25, 1976

[54] MEANS FOR INHIBITING THE FORMATION OF FRICTION POLYMERS ON BRUSH AND SLIP RING ASSEMBLIES

[75] Inventor: Charles G. Buckley, Phoenix, Ariz.

[73] Assignee: Sperry Rand Corporation, New York, N.Y.

[22] Filed: Nov. 21, 1972

[21] Appl. No.: 308,636

[52] U.S. Cl. ..... 310/232; 310/248

[51] Int. Cl.[2] ..... H01R 39/08

[58] Field of Search ..... 310/232, 51, 219, 229, 310/239, 241, 242, 245, 247, 248, 252, 251

[56] References Cited

UNITED STATES PATENTS

| | | | |
|---|---|---|---|
| 2,473,526 | 6/1949 | Hood | 310/232 |
| 3,185,951 | 5/1965 | Le Beau | 310/232 |
| 3,234,420 | 2/1966 | Linder | 310/248 |
| 3,475,635 | 10/1969 | Mabuchi | 310/248 |
| 3,614,726 | 10/1971 | Richter | 310/249 |
| 3,671,791 | 6/1972 | Muller | 310/219 |

FOREIGN PATENTS OR APPLICATIONS

| | | | |
|---|---|---|---|
| 371,505 | 10/1963 | Switzerland | 210/219 |

*Primary Examiner*—R. Skudy
*Attorney, Agent, or Firm*—Howard P. Terry; Thomas J. Scott

[57] ABSTRACT

A brush and slip ring assembly in which specific resilient characteristics are developed in the brushes by forming them in shapes which will allow the brushes to be simultaneously displaced a finite amount with the slip ring assembly in a vibratory environment which would otherwise produce relative sliding motion therebetween. By preventing the relative sliding motion between the brushes and slip ring assembly, the formation of electrically insulating friction polymers on the points of contact between the brushes and slip rings is inhibited.

9 Claims, 14 Drawing Figures

MEANS FOR INHIBITING THE FORMATION OF FRICTION POLYMERS ON BRUSH AND SLIP RING ASSEMBLIES

BACKGROUND OF THE INVENTION

1. Field of the Invention

The subject invention pertains to the art of slip ring and brush assemblies which are commonly used to provide a rotatable electrical coupling between circuits in systems or instruments and particularly to those slip ring and brush assemblies which are subjected to a significant vibratory environment.

2. Description of the Prior Art

Presently slip ring and brush assemblies are constructed to provide a force normal to the slip ring at the point of contact between the brush and the slip ring due to spring tension in the brush. In an environment where the slip ring and brush assembly are subjected to significant vibratory forces the slip ring tends to repetitively slide with respect to the brush at the point of contact. This sliding action can be produced as a result of rotational or translational displacements of the slip ring which are caused by the vibratory forces. The sliding action of the ring with respect to the brush enables friction polymers to form between the ring and brush at the point of contact thus producing electrical discontinuities.

Although the chemical and physical properties of the materials in the slip ring and brush assembly are factors in polymer formation and the quantity and nature of the chemical compounds which contaminate the atmosphere feed the process, the polymer formation cannot take place in the absence of relative sliding movement between the slip ring and the brush surfaces at the point of contact. Thus, polymer formation is likely to be most severe in those applications of slip ring and brush assemblies which are subject to significant vibratory environments.

Prior art devices were designed so that the spring force in the brushes which acted normal to the point of contact between the brush and slip ring assembly was sufficient to maintain the brush and slip ring in contact. However, in a high vibratory environment the slip ring can translate or rotate in a dithering motion with respect to the brushes. This relative motion occurs because the stiffness of the brushes in the tangential direction at the point of contact between the brush and slip ring is greater than the vibratory force in the tangential direction exerted on the slip ring. As a result the brush remains stationary while the slip ring is slid back and forth against the brush at the point of contact.

The polymer formations which are produced as a result of the relative sliding motion between the brush and slip ring at the point of contact are growths of hydrocarbons and other compounds that are produced from volatiles that are present in the environment around the point of contact. Certain materials used in the construction of slip rings and brushes are more catalytic than others and certain chemical compounds more readily provide nutrients that would serve as the source for the polymers, but one of the essential ingredients in polymer formation is motion. There has to be relative sliding motion between the surfaces and in prior art slip ring assemblies the relative motion is produced in a vibratory environment by the dithering displacement of the slip ring assembly with respect to the brushes.

The subject invention provides a combination brush and slip ring assembly which inhibits the formation of the friction polymers thereby reducing the occurrence of electrical discontinuities in a brush and slip ring assembly.

SUMMARY OF THE INVENTION

The invention provides a means for inhibiting the formation of friction polymers at the points of contact between the brushes and slip rings in a rotatable electrical coupling. The brushes are formed usually by bending in shapes that develop specific resilient characteristics which will allow the brushes to move simultaneously with the slip ring in response to applied low amplitude high frequency vibratory forces.

The magnitude of the vibratory forces which are expected to act upon the brush and slip ring assembly are determined empirically. In order to allow the brush to move simultaneously with the slip ring in response to the application of the vibratory forces, the maximum restraining force in the brush must be less than the amplitude of the vibratory forces. The value of the restraining force in the brush is determined by determining the maximum allowable brush spring constant, $k$, which is a function of the brush contact pressure, $p$, the displacement of the ring and the coefficient of sliding friction, $f$.

The brushes may be bent in various shapes having different bend angles and lengths to the different sections of the brush which may be readily calculated by those skilled in the art from the beam equations which are well known in the art of mechanics.

The particular shape of the brushes which is chosen to provide the required allowable spring constant, $k$, is determined from practical considerations such as the available length of the brushes, the direction or directions in which the ring is expected to be displaced in response to the bivratory forces, the spacing between the brushes and the available space in the vicinity of the brush and slip ring assembly.

In many applications a plurality of different shapes may be used to satisfy the requirements with respect to a specific brush and ring assembly to provide simultaneous displacement of the ring and the brushes. Thus, the final configuration chosen is a matter of design choice as long as the design chosen meets the maximum allowable brush spring constant, $k$.

In other applications only one or possibly two configurations may provide the maximum value of the brush spring constant, $k$, which is allowable for the given configuration of the brush and slip ring assembly. Thus, the most important feature of the invention is to provide a brush spring constant, $k$, which will enable the brush to be simultaneously displaced with the ring in response to the low amplitude, high frequency vibrational forces but which will not appreciably diminish the magnitude of the force, $p$, normal to the point of contact between the brush and slip ring.

DESCRIPTION OF THE PREFERRED EMBODIMENT

Figure 1:
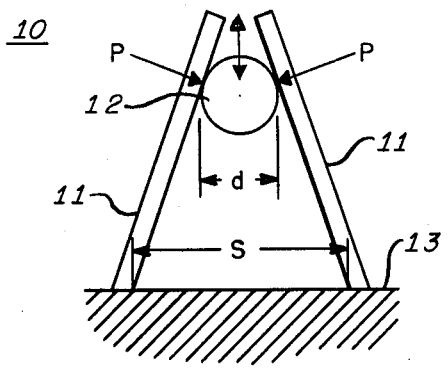
FIG. 1. PRIOR ART
FIG. 1 is a schematic diagram showing a brush and slip ring assembly of a prior art device in which the diameter of the slip ring is appreciably less than the distance between the brushes.
Figure 2:
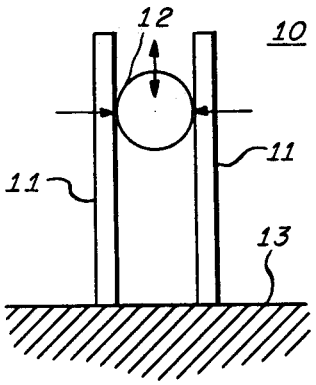
FIG. 2. PRIOR ART
FIG. 2 is a schematic diagram of a brush and slip ring assembly in which the diameter of the slip ring is approximately equal to the spacing between the brushes.
Figure 12:
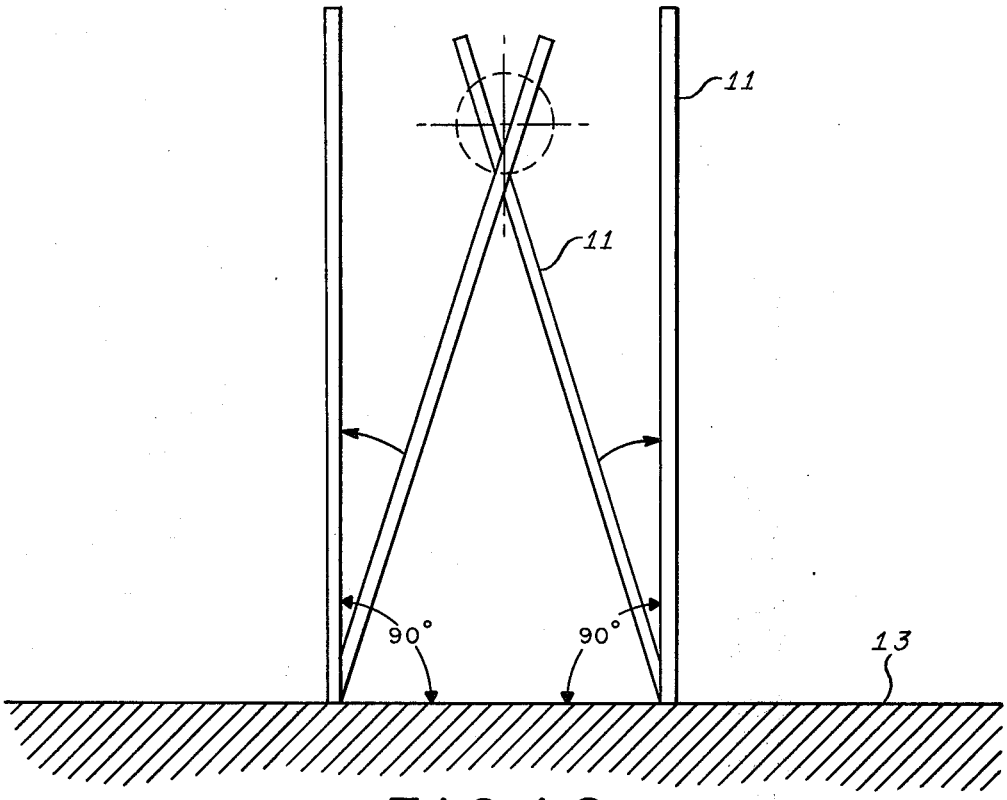
FIGS. 12–14 illustrate the preferred consecutive steps of forming brushes in shapes which incorporate the subject invention.

Two prior art brush and slip ring assemblies 10 are shown in FIGS. 1 and 2 respectively. FIG. 1 illustrates an assembly 10 in which the spacing, *s*, between the brushes 11 is substantially larger than the diameter, *d*, of the slip ring 12. In order to develop forces P, in the brushes 11 which are normal to the slip ring 12 at the point of contact, the brushes are bent from their quadrature position with respect to the base 13 so that they substantially overlap each other as shown in FIG. 12. When the brushes 11 are separated to allow for positioning of the slip ring therebetween, the tension forces P are developed at the point of contact between each brush 11 and slip ring 12. A similar procedure is used in the prior art embodiment shown in FIG. 2. Common parts depicted in each of the figures carry the same reference numeral, thus the brushes 11, the slip ring 12 and the block 13 appear in each of the FIGS. 1–15.

Figure 3:
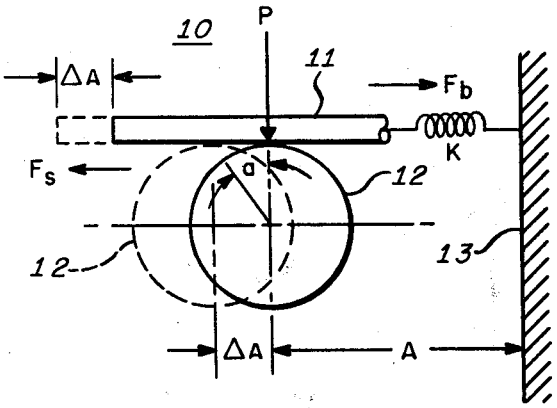
FIG. 3 is a schematic representation of translational and rotational displacement of a slip ring with respect to a brush.
Figure 4:
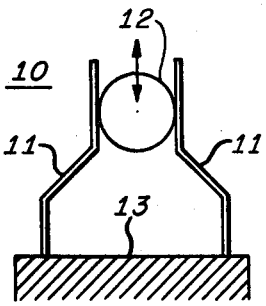
FIGS. 4–11 show various brush shapes which incorporate the teachings of the present invention.

The effect of vibratory forces on a brush and slip ring assembly will be described with reference to FIG. 3. Vibratory forces produce one of two different types of relative motion between a brush 11 and a slip ring 12. The first type of motion is translational. This is illustrated in FIG. 3 by the different positions of the brush 11 and the slip ring 12. The original position is shown in solid lines and the displaced position is shown in dashed lines. In prior art devices the spring force $F_b$ of the brush 11 is very high in the direction tangent to the point of contact in comparison to the frictional force $F_s$ exerted on the brush 11 by the slip ring 12. As a result, the brush 11 tends to remain stationary with respect to its original position while the slip ring 12 tends to be translationally displaced an amount Δ A to a new position represented by the slip ring 12 shown as a dashed cicle. Because of the vibratory nature of the forces exerted on the assembly 10, the slip ring 12 is cyclically displaced with respect to the brush 11, thereby causing sliding at the point of contact between the brush 11 and slip ring 12.

Sliding may be prevented from taking place due to the translational displacement ΔA of the ring 12 with respect to the brush 11 by reducing the magnitude of the spring force $F_b$ so that it will be less than the force $F_s$ necessary to cause sliding against friction. Mathematically this is expressed as: $F_b < F_s$.

Since $F_b = k \times \Delta A$ and $F_s = p \times f$

Where $k$ = brush spring constant – gm/cm $\Delta A$ = ring displacement – cm $p$ = *brush contact pressure – gm*

$f$ = coefficient of sliding friction – dimensionless then $$k < \frac{p \times f}{\Delta A}$$

is the design criterion which defines the maximum allowable spring constant in the brush 11.

When the spring force $F_b$ is less than the frictional force $F_s$ then the brush 11 will be translationally displaced an amount ΔA along with the slip ring 12 so that the relative sliding motion between the brush 11 and slip ring 12 is prevented and the formation of friction polymers at the point of contact is inhibited.

The second type of relative motion which may occur between the brush 11 and ring 12 shown in FIG. 3 is rotational motion. This is not the normal rotational motion of the ring with respect to the brush which provides the rotatable electrical coupling between circuits in systems or instruments. Rather the rotational motion referred to in this instance is a dithering motion usually having a small angular displacement such as the angle, *a*, shown in FIG. 3. In prior art devices the spring force, $F_b$, produced in the brush 11 by the brush spring constant, *k*, is larger than the frictional force $F_s$, which is applied to the assembly 10. Therefore, the ring 12 is rotationally displaced on angular amount, *a*, with respect to the stationary brush 11. This displacement produces sliding of the ring 12 with respect to the brush 11. To prevent sliding from taking place at the point of contact due to the rotational displacement, *a*, of the ring 12, it is necessary that the spring force $F_b$, in the brush 11 have a magnitude less than the frictional force, $F_s$, resulting from the rotational displacement. Mathematically, this is expressed as: $F_b < F_s$.

Since $$F_b = k \times \frac{d}{2} \times a \times \frac{\pi}{180} \text{ and } F_s = p \times f$$

where $k$ = brush spring constant – gm/cm $d$ = ring diameter – cm $a$ = angle of rotation – degrees $p$ = brush contact pressure – grams $f$ = coefficient of sliding friction – dimensionless then $$k < \frac{360\, p \times f}{\pi d \times a}$$

is the design criterion that defines the maximum allowable brush spring constant which will prevent relative rotational displacement, *a*, of the ring 12 with respect to the brush 11.

Therefore, given either of the prior art configurations shown in FIG. 1 or FIG. 2, the magnitude of the brush spring constant, *k*, required to allow the brush 11 to translate or rotate with the ring 12, may be calculated from the foregoing mathematical expressions when the brush contact pressure, *p*, coefficient of sliding friction, *f*, and the displacement due to the vibratory forces have all been determined. The desired brush spring constant, *k*, may be developed in the brushes by forming them in shapes which will produce the desired spring constant, i.e., the magnitude of the brush stiffness to movement in the tangential direction may be reduced by bending the brush in different shapes.

Figure 5:
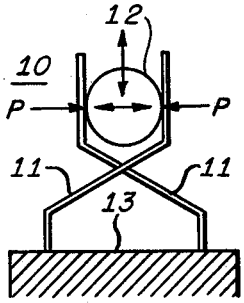
Figure 6:
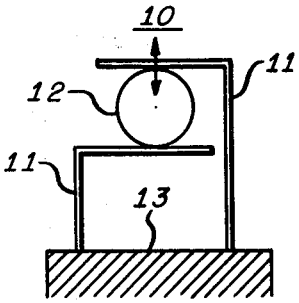
Figure 7:
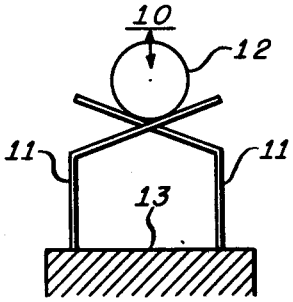
Figure 8:
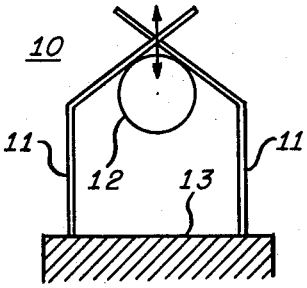
Figure 13:
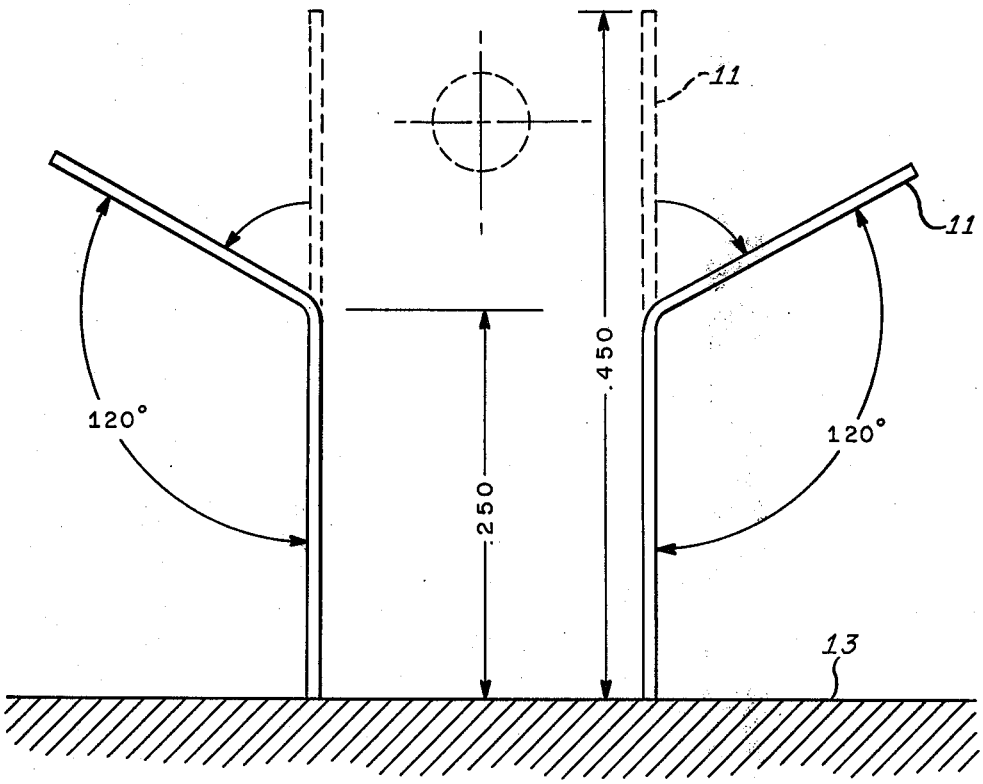
Figure 14:
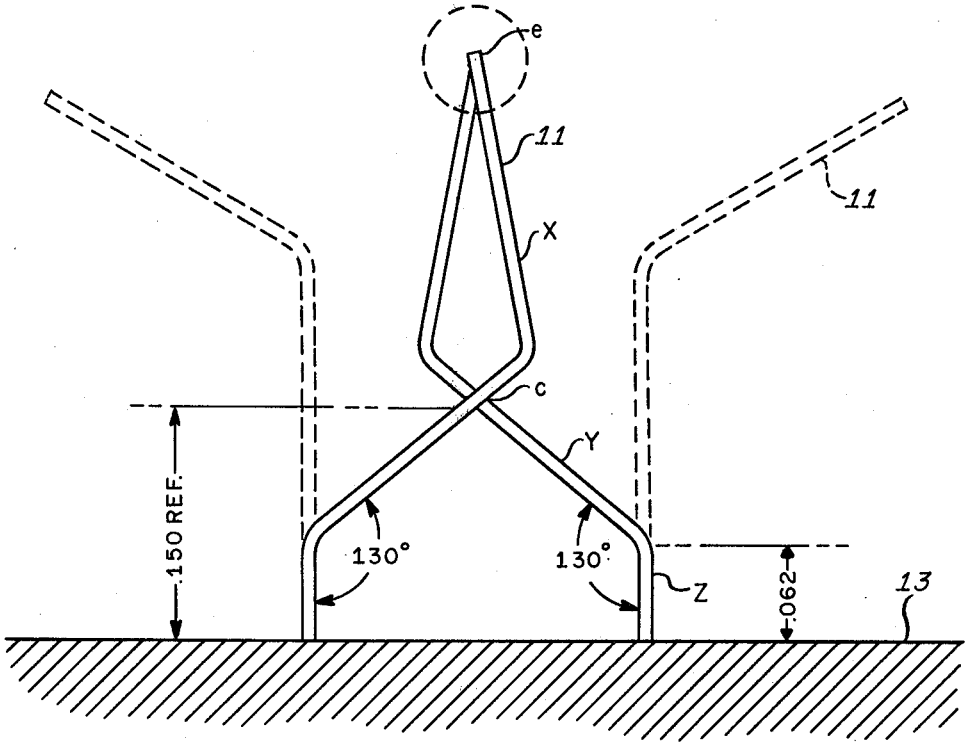

In a preferred embodiment of the invention, an assembly 10 shown in FIG. 1 was modified to produce the desired brush spring constant, *k*, to allow the brush 11 to be displaced with the ring 12. Referring to FIG. 12, a pair of brushes 11 are shown in their initial crossed position after the ring 12 has been removed. The first step is to straighten the brushes 11 which restores them to their quadrature position with respect to the base 13 indicated by the 90° angles. As shown in FIG. 13, each brush is then bent at a point approximately half way along the length of the brush 11. The angle of bend results in the extreme portion of the brush 11 forming an angle of 120° with the section of the brush in contact with the base 13. In one embodiment the radius of the bend angle, *b*, was 0.01 inches. With each of the brushes 11 bent out at the angles shown, it is obvious no contact would be made with a slip ring 12 positioned therebetween. Thus, each brush 11 is then bent at a point along its length near the base 13 so that the resultant shape, as shown in FIG. 14, produces a brush 11 in which the middle section, *y*, forms an angle of 130° with the base section, *z*. In one embodiment the length of the base section was 0.062 inches and the crossover point, *c*, between the two *y* sections of the two brushes 11 was 0.150 inches from the base 13. This provided a slight overlap between the end sections, *x*, of the brushes 11 at the point *e*. In each of the crossover sections, *c*, and *e*, there is no physical contact between the brushes 11. When the slip ring 12 is inserted between the brushes 11 shown in FIG. 14, the assembly has the resultant configuration as shown in FIG. 5 in which the brush spring constant, *k*, is provided by the middle section, *y*, of the brushes 11. FIGS. 4–8 and 11 show general brush shapes which may be formed in the brushes of prior art devices as shown in FIG. 1 that will inhibit the friction polymer formation by providing desired brush spring constants, *k*, in the direction of sliding motion.

Figure 9:
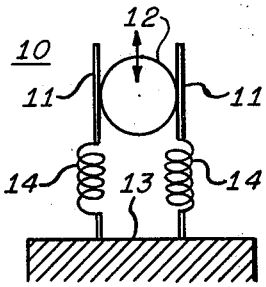
Figure 10:
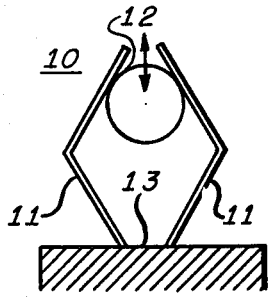
Figure 11:
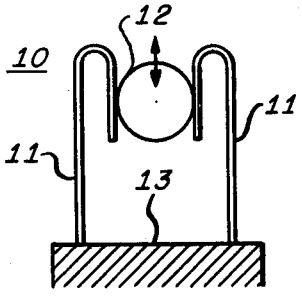

FIGS. 9–10 shows brush shapes which may be formed in prior art devices of the type shown in FIG. 2 to provide a desired brush spring constant, *k*, which will inhibit friction polymer formation at the point of contact between the brushes 11 and the ring 12. FIG. 9 shows a pair of brushes 11 which include a coil spring 14 formed in each brush between the section of the brush in contact with the ring 12 and the section in contact with the base 13. In this configuration the spring 14 provides the desired brush spring constant, *k*.

After the magnitude of the brush spring constant, *k*, has been determined for a particular brush and slip ring assembly 10 the configuration of the brushes 11 which will be used to provide the brush spring constant, *k*, is predicated on the type of brushes to be used, the spacing between the brushes, the available space in the immediate vicinity of the brush and slip ring assembly 10 and other pertinent practical considerations. The size of the angles and the relative lengths of the portions in each section of the formed brushes 11 is arrived at analytically by using the beam load equations which are well known in mechanics. Verification of the analytical approach is performed empirically by applying forces corresponding in magnitude to the forces expected to be present in the vibratory environment to the formed brushes and measuring the displacement thereof. The resulting measurements will be indicative of whether or not the brush spring constant, *k*, developed in the brush is within the maximum allowable range for the particular assembly as determined from the analytical approach referred to above.

In operation, a typical brush and slip ring assembly 10 incorporating the subject invention such as that shown in FIG. 5 will function in the following manner. During normal operation the slip ring 12 will rotate about its cenral axis with respect to the tangential brushes 11 in contact with the slip ring 12 at the points p. In the presence of vertical translational motion of the slip ring 12 relative to the block 13, as indicated by the double-headed arrow in FIGS. 1, 2 and 4–11 as would occur under applied vibration, brushes 11 will slide simultaneously back and forth at the point of contact P over the ring surface. In the formed configuration of the brushes 11 shown in FIG. 5, the stiffness in the brushes 11 to vertical displacement at point P is reduced with respect to the stiffness in the brushes 11 shown in FIG. 1 or FIG. 2 in order to prevent sliding motion from occurring at the point of contact.

In addition, the stiffness of the brushes 11 shown in FIG. 5 with respect to horizontal displacements is also reduced relative to the brush configurations shown in FIGS. 1 and 2. Therefore, the brushes 11 and slip ring 12 of FIG. 5 will also be simultaneously displaced in a horizontal direction with respect to vibrational forces acting thereon. As a result, the relative displacement between the slip ring 12 and brushes 11 which would occur in the configuration shown in FIGS. 1 and 2 is prevented by the configuration illustrated in FIG. 5. In a similar manner, low amplitude vibratory forces which cause dithering rotational displacement of the slip ring 12 with respect to the block 13 shown in FIGS. 1 and 2 will produce simultaneous sliding displacement of the brushes 11 and the slip ring 12 at point P. In FIG. 5, the brush spring constant, *k*, in the brushes 11 is reduced in the tangential direction in order to prevent sliding motion from occurring at the point of contact. However, forces which cause continuous rotatable motion of the slip ring 12 through large angular displacements only displace the brushes 11 an initial minimal amount subsequent to which they slide and remain stationary with respect to the rotating slip ring 12. Therefore, the resilient characteristics which are developed in the brushes 11 formed in accordance with the teachings of the subject invention effectively prevent relative movement between the slip ring 12 and the brushes 11 in a vibratory environment thereby inhibiting the formation of friction polymers at the points of contact between the brushes and slip ring. The various configurations shown in FIGS. 4–11 provide different degrees of a relative stiffness in the brushes 11. The choice of a particular configuration is determined by the expected operating parameters such as the direction of displacement due to the vibratory forces, the magnitude of the fibratory forces, the length of the brushes, the spacing between the brushes and the space available around the brush and slip ring assembly.

While the invention has been described in its preferred embodiments, it is to be understood that the words which have been used are words of description rather than limitation and that changes may be made within the purview of the appended claims without departing from the true scope and spirit of the invention in its broader aspects.

I claim:

1. A brush and slip ring assembly comprising:

slip ring means, block means disposed in the vicinity of said slip ring means and fixed with respect to said slip ring means for accommodating relative rotational motion between said block means and said slip ring means, brush conducting means having a surface in contact with said slip ring means for exerting a contact pressure normal to said surface of contact and producing a coefficient of friction therebetween, and spring conducting means coupled to said brush conducting means and affixed to said block means, said combination of slip ring means, block means, brush conducting means and spring means being subject to low amplitude, high frequency vibrations which tend to produce sliding displacements between said slip ring means and said brush conducting means thereby forming friction polymers therebetween, said spring conducting means having a spring constant of a value less than a prescribed value which allows said brush conducting means to be simultaneously displaced with said slip ring means through said displacements thereby inhibiting the formation of friction polymers between said slip ring means and said brush conducting means.

2. A brush and slip ring assembly as recited in claim 1 in which said brush conducting means exerts a contact pressure, $p$, and produces a coefficient of friction, $f$, said vibrations tend to produce sliding translational displacements of a magnitude $\Delta A$ and said spring conducting means has a spring constant, $k$, of a value lss than $pxf/\Delta A$.

3. A brush and slip ring assembly as recited in claim 1 in which said slip ring means has a diameter, $d$, said brush conducting means exerts a contact pressure, $p$, and produces a coefficient of friction, $f$, and said vibrations tend to produce sliding rotational displacements of a magnitude, $a$, and said spring conducting means has a spring constant, $k$, having a value less than 360 $pxf/\pi dxa$.

4. A brush and slip ring assembly as recited in claim 1 in which said spring conducting means includes a metallic strip integral with said brush conducting means and having at least one bend therein between said block means and said contact surface.

5. A brush and slip ring assembly as recited in claim 1 in which said slip ring means includes a ring having a diameter, d, and said brush conducting means includes a pair of oppositely disposed brushes having a spacing, S, in which the ratio of $S/d$ is greater than 1.

6. A brush and slip ring assembly as recited in claim 5 in which said spring conducting means includes a metallic strip integral with said brush conducting means and having at least one bend therein between said block means and said contact surface.

7. A brush and slip ring assembly as recited in claim 5 in which the spacing, S, between said oppositely disposed brushes equals the diameter, $d$, of the slip ring.

8. A brush and slip ring assembly as recited in claim 6 in which said spring conducting means includes a metallic strip integral with said brush conducting means and having at least one bend therein between said block means and said contact surface.

9. A brush and slip ring assembly as recited in claim 5 in which said spring conducting means includes metallic strips integral with said brushes and having at least one hairpin bend therein between said block means and said contact surface.

* * * * *